US009926497B2

(12) United States Patent
Choi et al.

(10) Patent No.: US 9,926,497 B2
(45) Date of Patent: Mar. 27, 2018

(54) METHOD TO REMOVE METALS FROM PETROLEUM

(71) Applicant: Saudi Arabian Oil Company, Dhahran (SA)

(72) Inventors: Ki-Hyouk Choi, Dhahran (SA); Emad N. Shafei, Salhat (SA); Ashok K. Punetha, Dhahran (SA); Joo-Hyeong Lee, Ras Tanura (SA); Mohammad A. Alabdullah, Dhahran (SA)

(73) Assignee: SAUDI ARABIAN OIL COMPANY (SA)

( * ) Notice: Subject to any disclaimer, the term of this patent is extended or adjusted under 35 U.S.C. 154(b) by 216 days.

(21) Appl. No.: 14/885,315

(22) Filed: Oct. 16, 2015

(65) Prior Publication Data

US 2017/0107433 A1 Apr. 20, 2017

(51) Int. Cl.
*C10G 55/02* (2006.01)
*C10G 9/00* (2006.01)
(Continued)

(52) U.S. Cl.
CPC ..... *C10G 55/02* (2013.01); *C10G 9/00* (2013.01); *C10G 21/08* (2013.01); *C10G 31/06* (2013.01);
(Continued)

(58) Field of Classification Search
CPC ..... C10G 55/02; C10G 31/10; C10G 21/08; C10G 9/00; C10G 31/08; C10G 31/06; C10G 2300/206; C10G 2300/202
See application file for complete search history.

(56) References Cited

U.S. PATENT DOCUMENTS 4,151,068 A 4/1979 McCollum et al.
4,483,761 A 11/1984 Paspek, Jr.
(Continued)

FOREIGN PATENT DOCUMENTS

WO 2015094948 A1 6/2015

OTHER PUBLICATIONS

PCT/US2016/056571 International Search Report and Written Opinion dated Jan. 23, 2017; 13 pgs.
(Continued)

*Primary Examiner* — Prem C Singh
*Assistant Examiner* — Juan Valencia
(74) *Attorney, Agent, or Firm* — Bracewell LLP; Constance Gall Rhebergen

(57) ABSTRACT

A method to remove a metals impurity from a petroleum feedstock for use in a power generating process is provided. The method comprising the steps of mixing a heated feedstock with a heated water stream in a mixing device to produce a mixed stream; introducing the mixed stream to a supercritical water reactor in the absence of externally provided hydrogen and externally provided oxidizing agent to produce a reactor effluent comprising a refined petroleum portion; cooling the reactor effluent to produce a cooled stream; feeding the cooled stream to a rejecter configured to separate a sludge fraction to produce a de-sludged stream; reducing the pressure of the de-sludged stream to produce a depressurized product; separating the depressurized product to produce a gas phase product and a liquid product; separating the liquid product to produce a petroleum product, having a reduced asphaltene content, reduced concentration of metals impurity, and reduced sulfur.

19 Claims, 3 Drawing Sheets

(51) Int. Cl.

| | |
|---|---|
| ***C10G 31/08*** | (2006.01) |
| ***C10G 31/06*** | (2006.01) |
| ***C10G 31/10*** | (2006.01) |
| ***C10G 21/08*** | (2006.01) |

(52) U.S. Cl.
CPC ..... *C10G 31/08* (2013.01); *C10G 31/10* (2013.01); *C10G 2300/202* (2013.01); *C10G 2300/206* (2013.01)

(56) References Cited

U.S. PATENT DOCUMENTS

| | | | | |
|---|---|---|---|---|
| 4,818,370 | A | 4/1989 | Gregoli et al. | |
| 4,840,725 | A | 6/1989 | Paspek | |
| 5,358,646 | A | 10/1994 | Gloyna et al. | |
| 5,611,915 | A | 3/1997 | Siskin et al. | |
| 5,695,632 | A | 12/1997 | Brons | |
| 7,264,710 | B2 | 9/2007 | Hokari et al. | |
| 7,842,181 | B2 | 11/2010 | Choi | |
| 8,367,425 | B1 | 2/2013 | Schabron et al. | |
| 8,535,518 | B2 | 9/2013 | Choi et al. | |
| 2002/0162332 | A1 | 11/2002 | Hazlebeck | |
| 2004/0232046 | A1 | 11/2004 | Tanaka et al. | |
| 2005/0040081 | A1 | 2/2005 | Takahashi et al. | |
| 2005/0177013 | A1 | 8/2005 | Countz | |
| 2007/0289898 | A1 | 12/2007 | Banerjee | |
| 2008/0099374 | A1 | 5/2008 | He et al. | |
| 2008/0099378 | A1 | 5/2008 | He et al. | |
| 2008/0135454 | A1 | 6/2008 | Choi | |
| 2009/0159498 | A1* | 6/2009 | Chinn | C10G 9/00 208/85 |
| 2009/0166261 | A1 | 7/2009 | Li et al. | |
| 2009/0166262 | A1 | 7/2009 | He et al. | |
| 2009/0206007 | A1 | 8/2009 | Allam | |
| 2010/0189610 | A1 | 7/2010 | Allam | |
| 2011/0147266 | A1 | 6/2011 | Choi | |
| 2011/0163011 | A1 | 7/2011 | Yarbro et al. | |
| 2011/0198085 | A1 | 8/2011 | O'Brien | |
| 2011/0266115 | A1 | 11/2011 | Berkowitz et al. | |
| 2011/0297506 | A1 | 12/2011 | Choi et al. | |
| 2011/0315600 | A1 | 12/2011 | Choi et al. | |
| 2012/0060418 | A1 | 3/2012 | Epstein et al. | |
| 2012/0061294 | A1* | 3/2012 | Choi | C10G 47/32 208/97 |
| 2012/0132566 | A1 | 5/2012 | Janssen et al. | |
| 2012/0138510 | A1 | 6/2012 | Choi et al. | |
| 2012/0181217 | A1 | 7/2012 | Choi et al. | |
| 2013/0140214 | A1 | 6/2013 | Choi | |
| 2013/0313162 | A1 | 11/2013 | Choi et al. | |

OTHER PUBLICATIONS

ASTM D. 3279-97 "Standard Test Method for n-Heptane Insolubles", American Society for Testing and Materials (2001) pp. 1-3.

ASTM D3053 "Standard Terminology Relating to Carbon Black" American Society for Testing and Materials; Published Jan. 2016; pp. 1-4.

Author unknown "Factsheet: Particle Properties of Carbon Black" International Carbon Black Association; date accessed Jun. 7, 2017; http://carbon-black.org/files/ICBA-Particle-CB-Factsheet-111413.pdf; pp. 1-4.

Baldwin, R. M., et al. "Coal liquefaction catalysis using iron pyrite and hydrogen sulfide", Preprints of Papers—American Chemical Society, Division of Fuel Chemistry, 27, Issue 3-4, pp. 254-260 (1982).

Gray, Murray R. "Consistency of Asphaltene Chemical Structures with Pyrolysis and Coking Behavior", Energy & Fuels, 17, pp. 1566-1569 (2003).

Iqbal, Rashid, et al. "Unlocking current refinery constraints." Petroleum technology quarterly 13.3 (2008). pp. 31-35.

Mandal, P. C., et al. "Non-catalytic vanadium removal from vanadyl etioporphyrin (VO-EP) using a mixed solvent of supercritical water and toluene: A kinetic study", Fuel, 92, pp. 288-294 (2012).

Premovic, Pavle I., et al. "Thermal stability of the asphaltene/kerogen vanadyl porphyrins." Organic geochemistry 24.8 (1996): 801-814.

Rahmani, S., et al., "Coking Kinetics of Asphaltenes as a Function of Chemical Structure", Energy & Fuels, 17, pp. 1048-1056 (2003).

Reynold, J. G. et al., in "Petroleum Chemistry and Refining", James G. Speight (Ed.), p. 74, Table 3.5, Taylor & Francis, 1998.

Takahashi, H., et al, "Characteristics of Vanadium Removal and Coke Formation Using Supercritical Water for Heavy Oil Upgrading", Journal of the Japan Petroleum Institute, 54, (2) pp. 96-102 (2011).

* cited by examiner

METHOD TO REMOVE METALS FROM PETROLEUM

FIELD OF THE INVENTION

This invention relates to methods for removing metals from petroleum-based hydrocarbon streams.

BACKGROUND OF THE INVENTION

Petroleum-based hydrocarbons, such as crude oil, can be separated into four fractions based on solubility in certain solvents: saturate, aromatic, resin, and asphaltene. Asphaltene is defined as a fraction which is not soluble in an n-alkane, particularly, n-heptane. The other fractions, which are soluble in n-alkane, are referred to as maltene.

There are many impurities in petroleum-based hydrocarbons, including, for example metals, sulfur, hydrogen, carbon, and components that include these impurities. Metals are primarily concentrated in the resin and asphalthene fractions; the remaining fractions can contain small amounts of metals. Vanadium, nickel and iron are the most frequently found metals in crude oil. In general, the asphalthene fraction has a higher concentration of vanadium than the resin fraction.

Metals found in petroleum-based hydrocarbons can cause severe problems in refining and other downstream processes such as petrochemical production processes. For example, metal compounds poison refining catalysts commonly used to enhance the processing of crude oil to meet the refined product specifications, for refining products such as gasoline and diesel. Metal compounds, particularly vanadium, in hydrocarbon-based liquid fuels can cause corrosion problems in hydrocarbon combustion processes, for example those used in power generation processes. In hydrocarbon combustion processes that employ gas turbines, the vanadium compound in the liquid fuel to the gas turbines can form vanadium oxide which can cause severe corrosion to metallic parts of the gas turbines.

Current methods of addressing the presence of metals in hydrocarbon-bearing petroleum streams include the use of additives injected with the hydrocarbon-bearing petroleum stream and processing steps to remove the metals before using the stream in a power generation process. In one application, additives are injected to trap vanadium compounds in a combustor. The additives suppress the corrosion effect of the vanadium compounds. While additives are effective to an extent, they cannot remove the metal compounds and therefore cannot completely prevent corrosion due to the presence of metals.

In conventional processing units, metal compounds are removed from the crude oil itself or from the its derivatives, such as refinery streams like residue streams. In a conventional hydroprocessing system, removal of metal compounds is achieved by a hydroprocessing unit where hydrogen is supplied in the presence of a catalyst. Metal compounds decompose through reactions with hydrogen and are then deposited on the catalyst. In most practices, following a period of operation the spent catalyst can be disposed. One of the disadvantages of conventional hydroprocessing systems involving catalysts is that it is nearly impossible to regenerate spent catalyst having deposited metals such as vanadium and nickel. Although conventional hydroprocessing can remove substantial amounts of metals from hydrocarbon streams, the process consumes huge amounts of hydrogen and catalyst. The short catalyst lifetime and huge hydrogen consumption contribute significantly to the costs associated with operating a hydroprocessing system. Large capital expenditures required to build a hydroprocessing unit coupled with the operating costs make it difficult for power generation plants to adopt such a complicated process as a pre-treatment unit of liquid fuel.

Another process that can be used to remove metals from petroleum-based hydrocarbons is a solvent extraction process. One such solvent extraction process is a solvent deasphalting (SDA) process. An SDA process can reject all or part of the asphalthenes present in a heavy residue to produce deasphalted oil (DAO). By rejecting the asphaltenes, the DAO has lower amount of metals than that of the feed heavy residue. The high removal of metals comes at the expense of liquid yield. For example, it is possible to reduce the metal content of an atmospheric residue from a crude oil from 129 part per million by weight (ppm by wt) to 3 ppm by wt in an SDA process; however the liquid yield of the demetallized stream is only around 75 volume percent (vol %).

Metals can be concentrated into certain parts of the petroleum products where the carbon to hydrogen ratio is higher than in other parts. For example, the coke or coke-like parts often contain highly concentrated metals. Specifically, vanadium can be concentrated into coke when heavy oil is treated with supercritical water under coking conditions, generally at high temperatures. Although coke formation could be beneficial to remove metals from liquid phase oil products, there are problems caused by coke: process lines are plugged by coke; liquid yield decreases with increasing amount of coke.

Supercritical water has unique properties which makes it suitable as a reaction medium for processing petroleum for certain reaction objectives such as upgrading and demetallization. Supercritical water is water above the critical temperature of water and above the critical pressure of water. The critical temperature of water is 373.946 degrees Celsius (° C.). The critical pressure of water is 22.06 megapascals (MPa). Supercritical water acting as a diluent prevents coke formation even without an external supply of hydrogen. The basic reaction mechanism of supercritical water mediated petroleum processes is the same as a radical reaction mechanism. Thermal energy creates radicals through chemical bond breakage. Supercritical water then creates a "cage effect" whereby radicals are surrounded by supercritical water and thus cannot react easily with each other. The cage effect enables supercritical water processes to have reduced coke formation as compared to conventional thermal cracking processes, such as delayed coker. "Coke" is generally defined to be the toluene insoluble material present in petroleum.

The majority of metals present in the resin and asphalthene fractions are known to be present as porphyrin-type compounds, where the metals are bonded to nitrogen by coordinative covalent bonds. The other forms of metal compounds have not been well identified, but at least some of the metal compounds exist as chelate type compounds.

A method that can remove metals from petroleum-based hydrocarbons while achieving high liquid yield is desired. A method that removes metals while reducing coke formation, minimizing generation of gas-phase product, and increasing liquid yield is desired.

SUMMARY

This invention relates to an apparatus and methods for removing metals from hydrocarbon-based petroleum. More specifically, the present invention relates to an apparatus and methods for converting metal compounds in hydrocarbon to certain metal compounds which can be removed from liquid phase hydrocarbon product.

In a first aspect of the present invention, a method to remove a metals impurity from a petroleum feedstock for use in a power generating process is provided. The method includes the steps of mixing a heated feedstock with a heated water stream in a mixing device to produce a mixed stream, the heated feedstock including the metals impurity, wherein the heated feedstock is heated to a feedstock temperature of 150° C. and a feedstock pressure greater than the critical pressure of water, wherein the heated water stream is heated to a water temperature above the critical temperature of water and a water pressure above the critical pressure of water, wherein the mixed stream includes an asphaltene and resin portion, a hydrocarbon portion, and a supercritical water portion, introducing the mixed stream to a supercritical water reactor in the absence of externally provided hydrogen and externally provided oxidizing agent to produce a reactor effluent, the reactor effluent including a refined petroleum portion and an amount of solid coke, wherein a demetallization reaction is operable to convert the metals impurity to a converted metal, wherein a set of conversion reactions is operable to refine the hydrocarbon portion in the presence of the supercritical water portion to produce the refined petroleum portion, cooling the reactor effluent in a cooling device to produce a cooled stream, feeding the cooled stream to a rejecter, the rejecter configured to separate a sludge fraction from the cooled stream to produce a de-sludged stream, the rejecter having a rejecter temperature, the sludge fraction including the asphaltene and resin portion and the converted metals, reducing the pressure of the de-sludged stream in a depressurizing device to produce a depressurized product, separating the depressurized product in a gas-liquid separator to produce a gas phase product and a liquid product, separating the liquid product in an oil-water separator to produce a petroleum product and a water product, the petroleum product having a liquid yield, the petroleum product having a reduced asphaltene content, reduced concentration of metals impurity, and reduced sulfur as compared to the petroleum feedstock.

In certain aspects of the present invention, the petroleum feedstock is a petroleum-based hydrocarbon selected from the group consisting of whole range crude oil, reduced crude oil, fuel oil, refinery streams, residues from refinery streams, cracked product streams from crude oil refinery, atmospheric residue streams, vacuum residue streams, coal-derived hydrocarbons, liquefied coal, bitumen, biomass-derived hydrocarbons, and hydrocarbon streams from other petrochemical processes. In certain aspects of the present invention, the metals impurity is selected from the group consisting of vanadium, nickel, iron and combinations thereof. In certain aspects of the present invention, the metals impurity includes a metal porphyrin. In certain aspects of the present invention, the set of conversion reactions is selected from the consisting of upgrading, desulfurization, denitrogenation, deoxygenation, cracking, isomerization, alkylation, condensation, dimerization, hydrolysis, hydration, and combinations thereof. In certain aspects of the present invention, the rejecter includes a rejecter adsorbent. In certain aspects of the present invention, the rejecter includes a rejecter solvent. In certain aspects of the present invention, the rejecter is selected from the group consisting of a cyclone-type vessel, a tubular-type vessel, a CSTR, and a centrifuge. In certain aspects of the present invention, the amount of solid coke in the reactor effluent is less than 1.5 weight percent (wt %) by petroleum feedstock. In certain aspects of the present invention, the concentration of metals impurity in the petroleum product is less than 2 ppm by wt. In certain aspects of the present invention, the liquid yield of the petroleum product is greater than 96 percent (%).

In a second aspect of the present invention, a method to remove a metals impurity from a petroleum feedstock for use in a power generating process is provided. The method including the steps of mixing a heated feedstock with a heated water stream in a mixing device to produce a mixed stream, the heated feedstock including the metals impurity, wherein the heated feedstock is heated to a feedstock temperature of 150° C. and a feedstock pressure greater than the critical pressure of water, wherein the heated water stream is heated to a water temperature above the critical temperature of water and a water pressure above the critical pressure of water, wherein the mixed stream includes an asphaltene and resin portion, a hydrocarbon portion, and a supercritical water portion, introducing the mixed stream to a supercritical water reactor in the absence of externally provided hydrogen and externally provided oxidizing agent to produce a reactor effluent, the reactor effluent including a refined petroleum portion, wherein a demetallization reaction is operable to convert the metals impurity to a converted metal, wherein a set of conversion reactions is operable to refine the hydrocarbon portion in the presence of the supercritical water portion to produce the refined petroleum portion, cooling the reactor effluent in a cooling device to produce a cooled stream, reducing the pressure of the cooled stream in a depressurizing device to produce a depressurized stream, wherein the depressurized stream includes the refined petroleum portion, an asphaltene fraction, a water fraction, and a gas phase product fraction, separating the depressurized stream in a gas-liquid separator to produce a gas product and a liquid phase stream, separating the liquid phase stream in an oil-water separator to produce a liquid-phase petroleum stream and a water phase stream, feeding the liquid-phase petroleum stream to a solvent extractor, extracting a petroleum product from the liquid-phase petroleum stream in the solvent extractor to leave a metal-containing fraction, the petroleum product having reduced asphaltene content, reduced concentration of metals impurity, and reduced sulfur as compared to the petroleum feedstock.

In certain aspects of the present invention, the petroleum feedstock is a petroleum-based hydrocarbon selected from the group consisting of whole range crude oil, reduced crude oil, fuel oil, refinery streams, residues from refinery streams, cracked product streams from crude oil refinery, atmospheric residue streams, vacuum residue streams, coal-derived hydrocarbons, liquefied coal, bitumen, biomass-derived hydrocarbons, and hydrocarbon streams from other petrochemical processes. In certain aspects of the present invention, the metals impurity is selected from the group consisting of vanadium, nickel, iron and combinations thereof. In certain aspects of the present invention, the metals impurity includes a metal porphyrin. In certain aspects of the present invention, the set of conversion reactions is selected from the consisting of upgrading, desulfurization, denitrogenation, deoxygenation, cracking, isomerization, alkylation, condensation, dimerization, hydrolysis, hydration, and combinations thereof. In certain aspects of the present invention, the solvent extractor includes a solvent deasphalting process. In certain aspects of the present invention, the amount of solid coke in the reactor effluent is less than 1.5 wt % by petroleum feedstock. In certain aspects of the present invention, the concentration of metals impurity in the petroleum product is less than 2 ppm by wt.

BRIEF DESCRIPTION OF THE DRAWINGS

These and other features, aspects, and advantages of the present invention will become better understood with regard to the following descriptions, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION OF THE INVENTION

Figure 1:
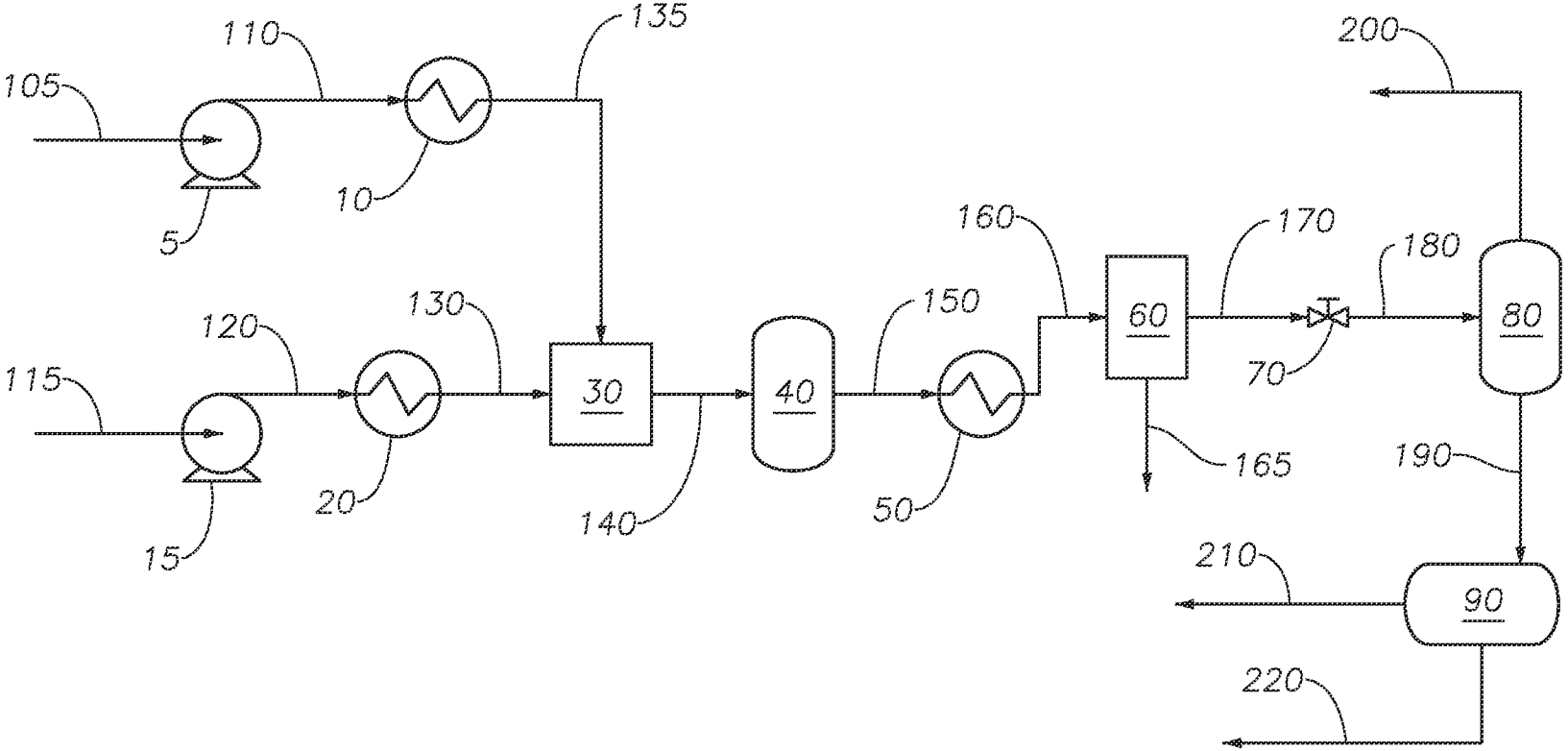
FIG. 1 provides a process diagram of one embodiment of the method of upgrading a hydrocarbon feedstock according to the present invention.

Although the following detailed description contains many specific details for purposes of illustration, it is understood that one of ordinary skill in the art will appreciate that many examples, variations and alterations to the following details are within the scope and spirit of the invention. Accordingly, the exemplary embodiments of the invention described herein and provided in the appended figures are set forth without any loss of generality, and without imposing limitations, relating to the claimed invention.

The present invention relates to methods to remove metal impurities from petroleum-based hydrocarbon streams using supercritical water to convert the metal impurities to metal compounds that are easier to remove from petroleum-based hydrocarbons without using hydrogen. While, "demetallization" refers to a process of removing metallic compounds from an oil to a non-oil phase, including a catalyst surface (in a hydrodemetallization process) and water (in a supercritical water process) and sludge process; as used herein demetallization refers to the a supercritical water process that optionally includes a concentration process to form a sludge.

The present invention provides methods to remove metals from petroleum. The demetallized streams can be used in power generation processes such as in a coker unit or conventional refining processes such as hydrocracker and fluid catalytic cracker. Power generation processes include those involving gas turbines. Gas turbines can be used with either gas fuels or liquid fuels. Thus, the demetallized streams can be a liquid fuel for gas turbines. The present invention provides methods to remove metallic compounds from petroleum-based hydrocarbon streams, while simultaneously upgrading the petroleum-based hydrocarbon stream to produce petroleum product streams that have lower density, lower sulfur content, lower asphaltene content, and increased API gravity. As used herein, "metallic compounds," "metals," or "metals impurity" refers to organic metallic compounds and does not cover inorganic metallic compounds. Inorganic metallic compounds include iron oxide and copper oxide and metal powders like copper metal powder. Inorganic metallic compounds can typically be removed by physical filters. Such physical filters can be installed upstream of a reactor to remove the inorganic compounds from a hydrocarbon-based petroleum stream before being injected through nozzles in the process, because the inorganic metallic compounds can plug nozzles. Organic metallic compounds are metallic compounds where the metal atoms are included in organic molecules through chemical bonds. Organic metallic compounds cannot be removed by physical filters. Organic metallic compounds can decompose in supercritical water. For example, vanadium porphyrins are known to decompose at temperatures above 400° C. through free radical reaction. The metal compounds produced as a result of the decomposition reactions in supercritical water can have various chemical structures, including oxide and hydroxide forms. In certain embodiments of the present invention, the resulting petroleum product with a reduced concentration of metals impurity can be used in a power generating process, for example, as a liquid petroleum fuel to a gas turbine. In certain embodiments, the present invention discloses methods to convert metallic hydrocarbons contained in petroleum-based liquid fuels with the aid of supercritical water in the absence of externally supplied oxidizing agent and in the absence of externally supplied hydrogen. Metallic hydrocarbons are decomposed or converted to metal compounds in the presence of supercritical water, where the conversion facilitates the removal of the metal compounds to produce an oil product that contains less metals.

In certain embodiments of the present invention, the methods to remove converted metals employ a separation step where converted metallic compounds (a metallic product) are separated from the oil product phase. The separation step is carried out using extraction, adsorption, centrifuging, filtering, and combinations thereof. In certain embodiments of the present invention, the method to remove metals includes a catalytic hydrogenation step that adds hydrogen to the demetallized oil product, which can increase the calorific value of the product fuel. In certain embodiments of the present invention, the methods to remove metals can include supercritical water gasification to produce hydrogen from hydrocarbons.

Referring to FIG. 1, a process for removing metal impurities from a petroleum feedstock is provided. Petroleum feedstock 105 is transferred to petroleum pre-heater 10 through petroleum pump 5. Petroleum pump 5 increases the pressure of petroleum feedstock 105 to produce pressurized feedstock 110. Petroleum feedstock 105 can be any source of petroleum-based hydrocarbons, including petroleum-based liquid fuels, that would benefit from hydrocarbon conversion reactions. Exemplary petroleum-based hydrocarbon sources include whole range crude oil, reduced crude oil, fuel oil, refinery streams, residues from refinery streams, cracked product streams from crude oil refinery, atmospheric residue streams, vacuum residue streams, coal-derived hydrocarbons, liquefied coal, bitumen, biomass-derived hydrocarbons, and hydrocarbon streams from other petrochemical processes. In at least one embodiment of the present invention, petroleum feedstock 105 is whole range crude oil. In at least one embodiment of the present invention, petroleum feedstock 105 is fuel oil. In at least one embodiment of the present invention petroleum feedstock 105 is an atmospheric residue stream. In at least one embodiment of the present invention, petroleum feedstock 105 is a vacuum residue stream. In at least one embodiment of the present invention, other petrochemical processes include processes that produce hydrocarbon streams of decant oil.

Pressurized feedstock 110 has a feedstock pressure. The feedstock pressure of pressurized feedstock 110 is at a pressure greater than the critical pressure of water, alternately greater than 23 MPa, and alternately between about 23 MPa and about 30 MPa. In at least one embodiment of the present invention, the pressure of pressurized feedstock 110 is 25 MPa.

Petroleum pre-heater 10 increases the temperature of pressurized feedstock 110 to produce heated feedstock 135. Petroleum pre-heater 10 heats pressurized feedstock 110 to a feedstock temperature. The feedstock temperature of heated feedstock 135 is a temperature below 300° C., alternately to a temperature between about 30° C. and 300° C., alternately to a temperature between 30° C. and 150° C., and alternately between 50° C. and 150° C. Temperatures above 350° C. cause coking of the petroleum in heated feedstock 135. Keeping the temperature of heated feedstock 135 below 350° C. reduces, and in some cases eliminates the production of coke in the step of heating the feedstock upstream of the reactor. In at least one embodiment of the present invention, maintaining the feedstock temperature of heated feedstock 135 at or below about 150° C. eliminates the production of coke in heated feedstock 135. Additionally, heating a petroleum-based hydrocarbon stream to 350° C., while possible requires heavy heating equipment, whereas heating to 150° C. can be accomplished using steam in a heat exchanger.

Water stream 115 is fed to water pump 15 to create pressurized water stream 120. Pressurized water stream 120 has a water pressure. Water pressure of pressurized water stream 120 is a pressure greater than the critical pressure of water, alternately greater than about 23 MPa, and alternately between about 23 MPa and about 30 MPa. In at least one embodiment of the present invention, pressurized water stream 120 is about 25 MPa. Pressurized water stream 120 is fed to water pre-heater 20 to create heated water stream 130.

Water pre-heater 20 heats pressurized water stream 120 to a water temperature to produce heated water stream 130. The water temperature of pressurized water stream 120 is a temperature above the critical temperature of water, alternately between about 374° C. and about 600° C., alternately between about 374° C. and about 450° C., and alternately above about 450° C. The upper limit of the water temperature is constrained by the rating of the physical aspects of the process, such as pipes, flanges, and other connection pieces. For example, for 316 stainless steel, the maximum temperature at high pressure is recommended to be 649° C. Temperatures below 600° C. are practical within the physical constraints of the pipelines. Heated water stream 130 is supercritical water at conditions above the critical temperature of water and critical pressure of water. In at least one embodiment of the present invention, the temperature difference between heated feedstock 135 and heated water stream 130 is greater than 250° C. Without being bound to a particular theory, a temperature difference between heated feedstock 135 and heated water stream 130 of greater than 250° C. is believed to increase the mixing of the petroleum-based hydrocarbons present in heated feedstock 135 with the supercritical water in heated water stream 130 in mixing device 30. Heated water stream 130 is in the absence of an oxidizing agent.

Water stream 115 and petroleum feedstock 105 are pressurized and heated separately. In an alternate embodiment, water stream 115 and petroleum feedstock 105 can be mixed at ambient conditions and then pressurized and heated as a mixed stream. Regardless of the order of mixing, petroleum feedstock 105 is not heated above 350° C. until after having been mixed with water stream 115 to avoid the production of coke.

Heated water stream 130 and heated feedstock 135 are fed to mixing device 30 to produce mixed stream 140. The temperature of mixed stream 140 is less than about 400° C., alternately less than about 374° C. and alternately less than 360° C. Above about 400° C. radical reactions can be induced in mixed stream 140, which can lead to demetallization reactions. In at least one embodiment of the present invention, to avoid demetallization reactions outside of the reactor, the temperature of mixed stream 140 is below 400° C. Avoiding demetallization reactions likely avoids any reactions between the streams and thus reduces coke production due to phase separation. Without being bound to a particular theory, it is believe that demetallization does not begin immediately, but requires time before a detectable level of demetallization can occur. The time frame for demetallization to reach 1% is about 5 seconds. The ratio of the volumetric flow rates of water to petroleum feedstock entering supercritical water reactor 40 at standard ambient temperature and pressure (SATP) is between about 1:10 and about 1:0.1, and alternately between about 1:1 and about 1:0.2. In at least one embodiment, the ratio of the volumetric flow rate of water to the volumetric flow of petroleum feedstock is in the range of 1 to 5. More water than petroleum is desired to disperse the petroleum. Using more water than oil in mixed stream 140 increases the liquid yield, over processes that have a low water to oil ratio or a ratio of more oil than water. Mixed stream 140 has an asphaltene and resin portion, a hydrocarbon portion, and a supercritical water portion. Poor mixing induces or accelerates reactions such as, oligomerization reactions and polymerization reactions, which result in the formation of larger molecules or coke. If metallic compounds such as vanadium porphyrins are embedded into such large molecules or coke, there is no way to remove the metallic compounds. The present method advantageously increases liquid yield over methods that concentrate metals into coke and then remove the metals from liquid oil product. In addition to decreasing liquid yield, such methods that concentration metals create problems for continuous operation, such as plugging of process lines. Thus, having a well-mixed mixed stream 40 increases the ability to remove metals according to the method of the invention. Mixed stream 140 is introduced to supercritical water reactor 40.

Mixed stream 140 is introduced to supercritical water reactor 40 to produce reactor effluent 150. In at least one embodiment of the present invention, mixed stream 140 passes from mixing device 30 to supercritical water reactor 40 in the absence of an additional heating step.

Supercritical water reactor 40 is operated at a temperature greater than the critical temperature of water, alternately between about 374° C. and about 500° C., alternately between about 380° C. and about 480° C., and alternately between about 400° C. and about 450° C. In a preferred embodiment, the temperature in supercritical water reactor 40 is between 400° C. and about 450° C. The upgrading reactions, including demetallization reactions in supercritical water reactor 40 can initiate at 400° C., while above 450° C. an increase in coke production is observed. Without being bound to a specific theory, it is not believed that the demetallization reactions will compete with other upgrading reactions occurring in supercritical water reactor 40. In at least one embodiment, the production of hydrogen sulfide during desulfurization reactions aids demetallization by propagating a radical through an HS radical. Supercritical water reactor 40 is at a pressure greater than the critical pressure of water, alternately greater than about 23 MPa, and alternately between about 23 MPa and about 30 MPa. The residence time of mixed stream 140 in supercritical water reactor 40 is longer than about 10 seconds, alternately between about 10 seconds and about 5 minutes, alternately between about 10 seconds and 10 minutes, alternately between about 1 minute and about 6 hours, and alternately between about 10 minutes and 2 hours. In at least one embodiment of the present invention, catalyst can be added to supercritical water reactor 40 to catalyze the conversion reactions. A catalysts can catalyze demetallization and other upgrading reactions concurrently. Without being bound to a particular theory, it is believed that catalyst can initiate reforming reactions that generate active hydrogen which enhances the upgrading reactions. The upgrading reactions that break large molecules into smaller ones enhance the demetallization reaction by providing more radicals for the demetallization reactions. Examples of catalyst suitable for use in the present invention, include metal oxides and metal sulfides. In at least one embodiment of the present invention, vanadium present in the mixed stream can act as a catalyst. In at least one embodiment of the present invention, supercritical water reactor 40 is in the absence of catalyst. Supercritical water reactor 40 is in the absence of externally supplied hydrogen. Supercritical water reactor 40 is in the absence of an externally supplied oxidizing agent. Process constraints reduce the ability to inject hydrogen or an oxidizing agent into supercritical water reactor 40. The present invention is in the absence of an oxidizing agent or oxidant because water can be a source of oxygen to convert metals present in the oil into metal oxides or metal hydroxides. The metal oxides and metal hydroxides remain in the water phase. In an alternate embodiment of the invention, the metals can be concentrated in a sludge, which can be removed the process. In at least one embodiment of the present invention, the operating conditions of supercritical water reactor: temperature, pressure, and residence time, are designed to reduce or minimize the production of solid coke, while concentrating converted metals in the asphaltene fraction.

The number of supercritical reactors employed in the process of the present invention varies based on the design needs of the process. One supercritical reactor can be employed, alternately two supercritical reactors arranged in series, alternately three supercritical reactors arranged in series, alternately four supercritical reactors arranged in series, and alternately more than four supercritical reactors arranged in series. In some embodiments of the present invention, a single supercritical water reactor 40 can be used. In a preferred embodiment of the present invention, two supercritical water reactors 40 are arranged in series. Having multiple reactors in the process increases process flexibility. In one embodiment, the reaction temperature can be increased gradually across multiple reactors, which cannot be done in a single reactor because it is difficult to achieve a wide temperature gradient in a single reactor. Using multiple reactors increases the flow path, which provides an opportunity for increased mixing and provides a long path for gradual temperature rise. Additionally, a longer flow path increases process stability. Supercritical water reactor 40 is in the absence of sudden heating of mixed stream 140 in order to avoid evaporation of hydrocarbons, as evaporation of hydrocarbons can cause precipitation of asphalthene, which leads to coke production. Thus, multiple reactors increase the mixing of the water and petroleum, which reduces coke production. In embodiments with more than one supercritical reactor in series, the reaction conditions in the first supercritical reactor can be the same as the reaction conditions in the second supercritical reactor, alternately the reaction conditions in the first supercritical reactor can be different than the reaction conditions in the second supercritical reactor. As used herein, reaction conditions refers to temperature, pressure, and residence time.

Mixed stream 140 includes a water portion, a hydrocarbon portion, and an asphaltene and resin portion. A metals impurity can be present in the hydrocarbon portion and the asphaltene and resin portion. Examples of the metals impurity present include metal porphyrins and non-porphyrin type metal. Examples of metal porphyrins include vanadium, nickel and iron. In at least one embodiment of the present invention, 50-80% of the metals present in mixed stream 140 are a non-porphyrin type metal. In at least one embodiment of the present invention, the metals impurity is vanadium porphyrin. The metals impurity present in mixed stream 140 undergoes demetallization reactions in supercritical water reactor 40 in the presence of supercritical water reactor 40. Demetallization reactions refer to those reactions where the metals impurity present in the hydrocarbon portion are converted or decompose to converted metals. Other impurities in the asphaltene and resin portion can be converted into hydrogen sulfide, ammonia, water, and other forms such as mercaptans. In some embodiments of the present invention, sulfur, nitrogen and oxygen can be released when the bond with carbon is broken. Exemplary converted metals include metal oxides, metal hydroxides, organometallic compounds, and combinations thereof. In at least one embodiment of the present invention, the vanadium porphyrin metals impurity present in mixed stream 140 undergoes a demetallization reaction and becomes a vanadium hydroxide converted metal. In at least one embodiment of the present invention, the vanadium porphyrin metals impurity present in mixed stream 140 undergoes a demetallization reaction and becomes a vanadium oxide converted metal. In a least one embodiment of the present invention, a set of conversion reactions can occur in supercritical water reactor 40. The set of conversion reactions is selected from upgrading, desulfurization, denitrogenation, deoxygenation, cracking, isomerization, alkylation, condensation, dimerization, hydrolysis, and hydration, and combinations thereof. The set of conversion reactions produce a refined petroleum portion.

The demetallization reactions in supercritical water reactor 40 in the presence of supercritical water produce a reaction product, effluent 150, that contains an amount of solid coke of less than 1 wt % by petroleum feedstock, alternately less than 1.5 wt % by petroleum feedstock, alternately less than 0.8 wt % by petroleum feedstock, alternately less than 0.6 wt % by petroleum feedstock, and alternately less than 0.5 wt % by petroleum feedstock. An amount of solid coke of less than 1 wt % by petroleum feedstock is considered to be free from solid coke. Without being bound to a particular theory, it is believed that production of solid coke ("coking") can be avoided by avoiding three conditions in a supercritical water reactor: high temperatures, such as temperatures above 500° C., as high temperatures populate radicals for inducing inter-radical condensation; phase separation, while part of the petroleum feedstock can be present as a separate phase, mixing of hydrocarbons and supercritical water in one phase or substantially one phase reduces coking; and long residence times, coking needs an induction period, thus limiting the residence time of coke precursors, such as asphaltenes, can limit coking. Demetallization reactions in the presence of supercritical water can produce a reaction product that produces a gas-phase product totaling less than about 5 wt % by petroleum feedstock, alternately less than about 6 wt % by petroleum feedstock, 5.5 wt % by petroleum feedstock, 4.5 wt % by petroleum feedstock, 4 wt % by petroleum feedstock, and alternately 3.5 wt % by petroleum feedstock. Gas-phase products in the reaction products less than about 5 wt % by petroleum feedstock are considered small amounts of gas-phase products.

In at least one embodiment of the present invention, the demetallization reactions are found to concentrate the converted metals in the resin fraction and asphaltene fraction without generating coke in the presence of supercritical water. In at least one embodiment of the present invention, the part of the metals impurity that is not converted to a converted metal is concentrated in the asphalthene fraction. Without being bound to a particular theory, it is believed that the following concentration occurs in the asphalthene fraction. The non-metallic asphalthene, that is asphalthene that is in the absence of metals, decomposes faster than metallic asphalthene, meaning that the non-metallic asphalthene is left behind in the asphalthene fraction as the non-metallic asphalthene dissolves. As the metals impurity in the asphalthene is converted to metal oxides or metal hydroxides, the metal oxides and metal hydroxides along with other inorganic metal compounds are attracted to the resin, due to the high polarity of resin, and can attach to the resin. The asphalthene fraction has many aromatic rings where delocalized pi-electrons can attract the metal oxide and metal hydroxides. As a result, the asphalthene fraction from the reactor has higher concentration of metals compared to the asphalthene fraction in petroleum feedstock 105, even if the total metal content in the product is lower. As a result of concentrating the converted metals into the resin fraction and asphalthene fraction, the maltene fraction can have a lower metal content as required for power generation.

In at least one embodiment of the present invention, supercritical water reactor 40 is in the absence of a process to remove solids, or dregs, directly from supercritical water reactor 40. In at least one embodiment of the present invention, supercritical water reactor 40 is in the absence of a separate outlet stream for a solids or dregs stream, thus in the present invention any solids or dregs are removed with the reactor product stream. In at least one embodiment of the present invention, supercritical water reactor 40 is in the absence of a solids settling area.

Reactor effluent 150 contains the reaction products. Reactor effluent 150 is fed to cooling device 50 to produce cooled stream 160. Cooling device 50 can be any device capable of cooling reactor effluent 150. In at least one embodiment of the present invention, cooling device 50 is a heat exchanger. Cooled stream 160 is at a temperature below the critical temperature of water, alternately below 300° C., and alternately below 150° C. In at least one embodiment of the present invention, cooled stream 160 is at a temperature of 50° C. In at least one embodiment of the present invention, cooling device 50 can be optimized to recover heat from cooling reactor effluent 150 and the recovered heat can be used in an another unit of the present process, or in another process. In at least one embodiment of the present invention, recovered heat from cooling device 50 is used in solvent extractor 92. Reactor effluent 150 contains a well-mixed emulsion of oil and water. In at least one embodiment of the present invention, reactor effluent 150 is a uniform or nearly uniform phase. Reducing the temperature in cooling device 50 causes the phases to separate, such that cooled stream 160 contains separate oil and water phases. Without being bound to a particular theory, the phase separation is believed to occur according to the following path. As the temperature of reactor effluent 150 falls below the critical temperature of water, the heavy fraction, containing the asphaltene and converted metals, is separated from water while the other fractions remain dissolved.

Cooled stream 160 is fed to rejecter 60 to separate out sludge fraction 165 and produce de-sludged stream 170. Rejecter 60 can be any type of process vessel capable of separating a sludge from a liquid stream containing hydrocarbons and water. Exemplary process vessels suitable for use as rejecter 60 include cyclone-type vessels, tubular-type vessels, CSTR-type vessel, and centrifuge. "Sludge" as used herein refers to the accumulated asphaltene fraction containing all or substantially all of the converted metals as well as water in an emulsion. Sludge fraction 165 contains between 30 wt % and 70 wt % of the converted metals, alternately between 40 wt % and 60 wt % of the converted metals, and alternately at least 50 wt % of the converted metals. The percentage of converted metals refers to the fraction of metals present in the sludge fraction compared to the total metals present in petroleum feedstock 105. In at least one embodiment, at least 30 wt % of the converted metals are dispersed in the water in the sludge. In at least one embodiment, the sludge contains at least 30 wt % asphaltene, and at least 10 wt % water. The remaining converted metals and any unconverted metals are in de-sludge stream 170. Unconverted metals in de-sludge stream 170 can be present in the oil phase and converted metals can be present in the water phase. Rejecter 60 is operated at a rejecter temperature. The rejecter temperature in the range of between about 200° C. and about 350° C., alternately between about 225° C. and about 325° C., and alternately between about 250° C. and about 300° C. In a preferred embodiment, rejecter 60 is maintained at a temperature of between about 250° C. and about 300° C. The temperature of rejecter 60 is lower than the critical temperature of water to induce phase separation, such that the asphaltene fraction separates from the other hydrocarbons present in cooled stream 160. At temperatures above the critical temperature, the water dissolves or disperses asphalthene, thus by lowering the temperature below the critical temperature the asphaltene fraction can agglomerate. The temperature in rejecter 60 is above the temperature at which the non-asphaltenic fraction undergoes phase separation. In other words, the temperature of rejecter is maintained in a range to allow asphaltenic fractions to separate from cooled stream 160, but maintains the non-asphaltenic fraction mixed with the water in cooled stream 160. In at least one embodiment of the present invention, the temperature of cooled stream 160 is adjusted in cooling device 60 to achieve the desired operating temperature of rejecter 60. In at least one embodiment of the present invention, rejecter 60 has an external heating device to maintain the temperature. Rejecter 60 is designed so that pressure drop of cooled stream 160 through rejecter 60 is such that water is maintained in the liquid phase regardless of the temperature. Pressure drop through the rejecter is in the range between about 0 MPa and about 5 MPa, alternately between about 0.1 MPa and about 4 MPa, alternately between about 0.1 MPa and about 3.0 MPa, alternately between about 0.1 MPa and about 2.0 MPa, and alternately between about 0.1 MPa and about 1.0 MPa. In a preferred embodiment, the pressure drop through rejecter 60 is in the range between 0.1 MPa and 1.0 MPa. In certain embodiments, a rejecter adsorbent can be added to rejecter 60. The rejecter adsorbent can be any adsorbent that allows sludge in cooled stream 160 to selectively accumulate in rejecter 60 so that it can be separated as sludge fraction 165. Exemplary adsorbents for use as the rejecter adsorbent include metal oxides and solid carbons. In certain embodiments of the present invention, the adsorbent can be annealed or treated with certain chemicals for passivating its surface reactivity. For example, solid carbon can be thermally treated at 800° C. under nitrogen to remove surface active species such as a carboxylic acid type functional group on the surface of the solid carbon, in order to prevent catalytic action of the adsorbent. The adsorbent in rejecter 60 can be in a fixed bed, a fluidized bed, or a trickle bed. The adsorbent can fill between 5 vol % and 95 vol % of rejecter 60. In at least one embodiment of the present invention, the adsorbent is in the absence of catalytic effect on the sludge. In at least one embodiment of the present invention, the rejecter adsorbent is a solid carbon such as activated carbon fiber. In at least one embodiment, rejecter 60 is in the absence of a rejecter adsorbent. In certain embodiments, a rejecter solvent can be added to rejecter 60. The rejecter solvent can be any solvent that enhances separation efficiency of the sludge from the liquid stream. Exemplary solvents that can be used as the rejecter solvent include pentane, hexane, heptane, benzene, toluene, and xylene. The amount of rejecter solvent is in the range of between about 0.05 vol % of cooled stream and 10 vol % of cooled stream, alternately between about 0.1 vol % and about 1 vol % of cooled stream, alternately between about 1 vol % and about 10 vol % of cooled stream. In at least one embodiment, rejecter 60 is in the absence of a rejecter solvent. In certain embodiments both a rejecter adsorbent and a rejecter solvent can be added to rejecter 60. In at least one embodiment of the present invention, rejecter 60 is in the absence of an oxidizing agent. As used herein, "oxidizing agent" refers to those species which can react with other compounds to convert the compounds to oxides. Exemplary oxidizing agents absent from the present invention include oxygen, air, hydrogen peroxide, aqueous hydrogen peroxide, nitric acid, and nitrates. Sludge fraction 165 can be disposed of, or sent for further processing. In at least one embodiment of the present invention, sludge fraction 165 is in the absence of being recycled back to supercritical water reactor 40. Rejecter 40 separates the fractions of cooled stream 160 that are insoluble in subcritical water, including compounds in cooled stream 160 that are soluble in supercritical water, but not soluble in subcritical water. In at least one embodiment of the present invention, rejecter 40 removes more converted metals than processes that separate a stream directly from the supercritical water reactor. Without being bound to a particular theory, it is noted that supercritical water has a higher solubility toward hydrocarbons than subcritical water. Conversely, supercritical water has a lower solubility toward hydrocarbons than subcritical water. Sludge fraction 165 is in the absence of being mixed with supercritical water. Sludge fraction 165 can contain a small amount of upgraded hydrocarbons.

De-sludged stream 170, containing petroleum-based hydrocarbons and water, passes through depressurizing device 70. Depressurizing device 70 reduces the pressure of de-sludged stream 170 to create depressurized product 180. Depressurizing device 70 can be any device capable of reducing the pressure of a liquid stream. In at least one embodiment of the present invention, depressurizing device 70 is a control valve. The pressure of depressurized product 180 is below about 5 MPa, alternately below about 4 MPa, alternately below about 3 MPa, alternately below about 2 MPa, alternately below about 1 MPa, and alternately below about 0.5 MPa. In at least one embodiment of the present invention, the pressure of depressurized product 180 is atmospheric pressure. In a preferred embodiment of the present invention, the pressure of depressurized product 180 is less than 1 MPa. Depressurized product 180 is introduced to gas-liquid separator 80.

Gas-liquid separator 80 separates depressurized product 180 into gas phase product 200 and liquid product 190. Gas phase product 200 can be released to atmosphere, further processed, or collected for storage. Gases are produced when petroleum is treated in supercritical water. The quantity of gas produced is impacted by the temperature in the supercritical water reactor, the residence in the supercritical water reactor, and the extent to which the petroleum feed and the water stream are mixed. Gas phase product 200 contains methane, ethane, propane, butane, hydrogen, carbon dioxide, carbon monoxide, hydrogen sulfide, other light molecules, and combinations thereof. Liquid product 190 includes hydrocarbons with more than 5 carbons (the C5+ fraction), meaning liquid product 190 includes hydrocarbons having 5 or more carbons. Gas phase product 200 is in the absence of any metals impurity or converted metal.

Liquid product 190 enters oil-water separator 90 where the stream is separated into petroleum product 210 and water product 220. Petroleum product 210 contains the refined petroleum product. The liquid yield of petroleum product 210 is greater than 95%, alternately greater than 96%, alternately greater than 97%, alternately greater than 98%, alternately greater than 99%, and alternately greater than 99.5%. The concentration of metals impurity in petroleum product 210 is less than 2 ppm vanadium by wt, alternately less than 1 ppm vanadium by wt, alternately less than 0.8 ppm vanadium by wt, and alternately less than 0.5 ppm vanadium by wt. In at least one embodiment of the present invention, the concentration of metals impurity is less than 0.5 ppm vanadium by wt. Alternately, the amount of metals impurity converted in the method of the present invention is greater than 99 wt %, alternately greater than 99.25 wt %, alternately greater than 99.5 wt %, alternately greater than 99.75 wt %. In at least one embodiment of the present invention, water product 220 contains at least 30 wt % of the converted metals.

Figure 2:
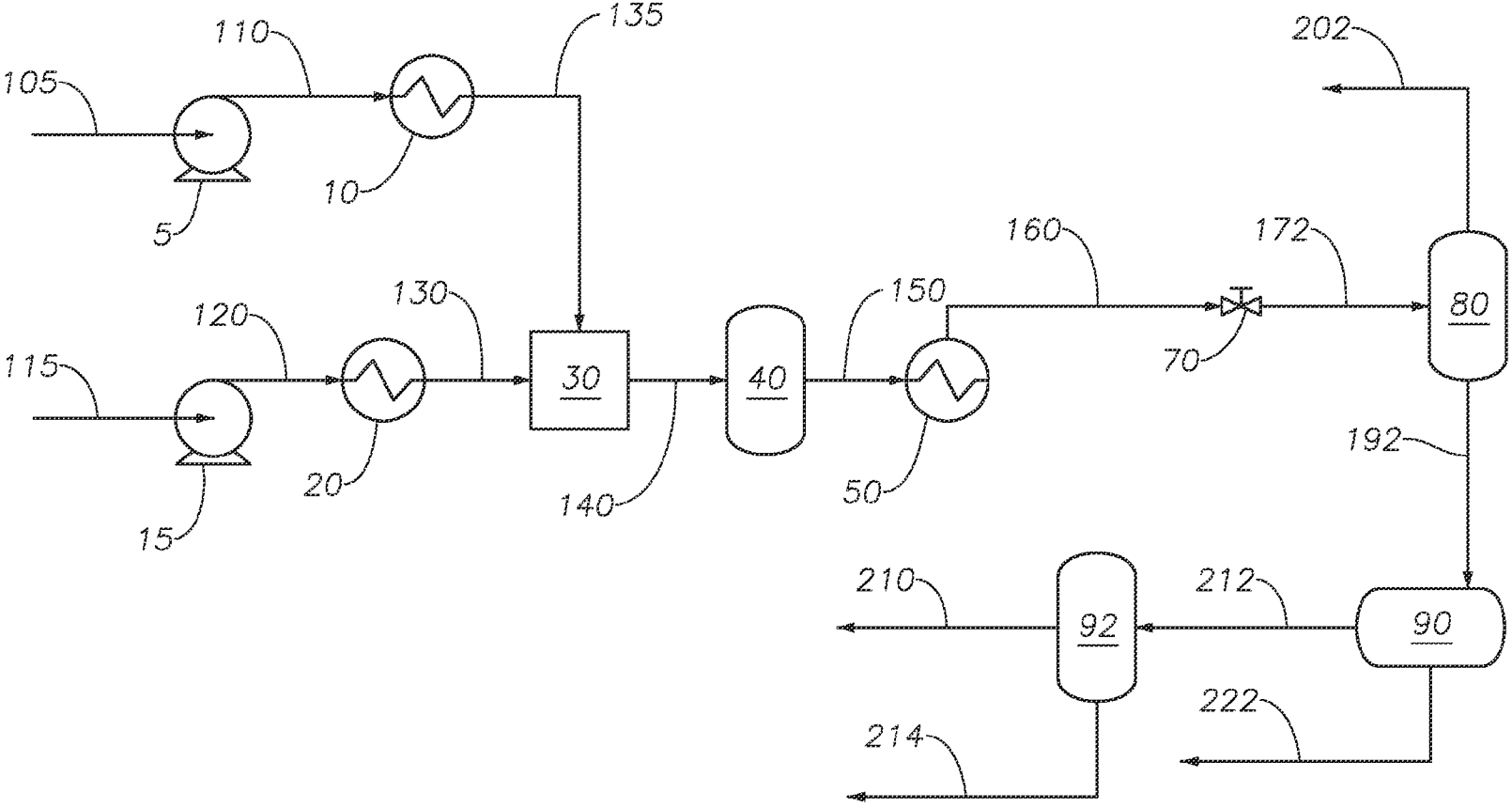
FIG. 2 provides a block diagram of an embodiment of a mixing unit according to the prior art.

FIG. 2 discloses an alternate embodiment of the present invention. With reference to the process and method as described in FIG. 1, cooled stream 160 is fed to depressurizing device 70 to produce depressurized stream 172. Depressurized stream 172 includes a petroleum product, including the asphaltene fraction, a water fraction, and a gas phase product fraction. The pressure of depressurized stream 172 is below about 5 MPa, alternately below about 4 MPa, alternately below about 3 MPa, alternately below about 2 MPa, alternately below about 1 MPa, and alternately below about 0.5 MPa. In at least one embodiment of the present invention, the pressure of depressurized stream 172 is atmospheric pressure. In a preferred embodiment of the present invention, the pressure of depressurized stream 172 is less than 1 MPa. Depressurized stream 172 is introduced to gas-liquid separator 80.

Gas-liquid separator 80 separates depressurized stream 172 into gas product 202 and liquid phase stream 192. Without being bound to a particular theory, it is believed that gas product 202 can have more gas (higher volumetric flow rate) than gas phase product 202, because gases can be removed with sludge fraction 165 in rejecter 60. For example, carbon dioxide has a high affinity for subcritical water and therefore is likely to stay dissolved in subcritical water, including the water that forms a portion of sludge fraction 165. In addition, the composition of gas product 202 can be different than the composition of gas phase product 200. Gas product 202 is in the absence of any metals impurity or converted metal.

Liquid phase stream 192 is fed to oil-water separator 90 where the stream is separated into liquid-phase petroleum stream 212 and water phase stream 222. The content of metals in water phase stream 222 is higher than in water product 220 in the absence of separating out the sludge. Liquid-phase petroleum stream 212 includes an asphaltene fraction and a hydrocarbon fraction. Liquid-phase petroleum stream 212 is fed to solvent extractor 92.

Solvent extractor 92 separates liquid-phase petroleum stream 212 into petroleum product 210, the low metal fraction, and metal-containing fraction 214, a high metal fraction. Solvent extractor 92 can employ any type of solvent extraction process that separates a metal containing fraction based on the solubility in a solvent. Example solvent extraction processes include a solvent deasphalting process. An example of a solvent deasphalting process is Residuum Oil Supercritical Extraction (ROSE®). A conventional solvent deasphalting process includes a separation of asphaltene from maltene using a solvent, such as propane, butane, or pentane. A solvent deasphalting process can remove 99 wt % metals from a stream, but liquid yield will be low. The low liquid yield in a solvent deasphalting process is due to the wide distribution of the asphaltene fraction within the maltene fraction, thus requiring removal of some of the maltene fraction along with the asphalthene fraction. In at least one embodiment of the present invention, the liquid yield is higher than in a conventional solvent deasphalting process because the asphaltene distribution is narrower than in an untreated petroleum feedstock. Solvent extractor 92 operates below the critical point of water. In at least one embodiment of the present invention, multiple separation steps are employed to increase efficiency. In at least one embodiment, metal-containing fraction 214 contains between 60 wt % and 90 wt % of the metals in liquid-phase petroleum stream 212.

The properties and composition of petroleum product 210 are described with reference to FIG. 1.

In at least one embodiment of the present invention, the asphaltene fraction containing the converted metals can be separated from the liquid petroleum phase and water phase downstream of the supercritical water reactor in a separator device operating at subcritical temperature and pressure (below the critical point of water). The separator device can have a settling chamber or drainage device. In certain embodiments, an adsorbent can be added to accelerate the separation of the asphaltene fraction from the liquid petroleum phase and water phase, the adsorbent is added in the presence of the water phase, in the order of processing steps upstream of the oil-water separator. The adsorbent can be any adsorbent that stays in the water phase after the fluid stream has returned to ambient temperature and pressure. This allows the adsorbent to be removed in a water purification step, where the water purification step can remove the adsorbent. In at least one embodiment, the adsorbent can also trap sulfur compounds reducing the sulfur content of the final petroleum product.

In at least one embodiment of the present invention, an adsorption process can be used downstream of the supercritical water reactor after a gas-liquid separator to separate the metal containing asphaltene fraction from the maltene fraction. In at least one embodiment, the adsorption process includes a vessel filled with an adsorbent. The adsorbent can be in a fixed bed, an ebullated bed, a fluidized bed, or any other configuration that will allow the adsorbent to separate the metal containing asphalthene fraction from the maltene fraction.

In at least one embodiment of the present invention, a catalytic hydrogenation unit can be included in the process to accept the petroleum product stream, where the catalytic hydrogenation unit adds hydrogen to the petroleum product. The added hydrogen increases the calorific value of the petroleum product, which increases the value as a liquid fuel. In at least one embodiment of the present invention, the petroleum in the reactor effluent includes hydrocarbons with double bonds. The double bonds of the hydrocarbons can be saturated by a hydrogenation catalyst in the presence of an external supply of hydrogen. Hydrogenation process remove limited amounts of metals (no more than 5%) due to the mild operating conditions. For example, hydrogenation processes can be performed with a conventional cobalt-molybdenum/aluminum oxide ($CoMo/Al_2O_3$) catalyst at 5 MPa and 320° C. with a hydrogen to hydrocarbon ratio of 100 $Nm^3/m^3$ and a liquid hourly space velocity (LHSV) of 2. The primary objective of a hydrogenation process is to increase hydrogen content by hydrogenating olefinic compounds and thereby increasing the calorific value of the hydrogenated hydrocarbon stream.

The supercritical water process disclosed in this invention can be installed as a standalone unit (producing just demetallized hydrocarbon) or combined with a power generating plant. The combination includes connecting utilities (for example, steam and electricity) between the supercritical water process and the power generating process.

The methods provided herein to remove metals from a petroleum feedstock are in the absence of a distillation step using a distillation column or distillation unit.

EXAMPLE

Example 1

A process for demetallizing a petroleum feedstock in the presence of supercritical water was carried out in a pilot scale plant according to the configuration as shown in FIG. 2. Petroleum feedstock 105 was a whole range Arabian Light crude oil at a volumetric flow rate of 0.2 Liter/hour (L/hour). The temperature of petroleum feedstock 105 was 21° C. and the pressure was increased to a pressure of 25 MPa in petroleum pump 5 to produce pressurized feedstock 110. The temperature of pressurized feedstock 110 was raised to 50° C. in petroleum pre-heater 10 to produce heated feedstock 135, still at a pressure of 25 MPa. Water stream 115 was at a volumetric flow rate of 0.6 L/hour at a temperature of 17° C. and increased to a pressure of 25 MPa in water pump 15 to produce pressurized water 120. Pressurized water 120 was heated in water pre-heater 20 to a temperature of 480° C. to produce heated water stream 130. Heated water stream 130 and heated feedstock 135 were fed to mixing device 30 to produce mixed stream 140. Mixed stream 140 then was fed to supercritical water unit, having supercritical water reactor 40 and supercritical water reactor 40A in series. Supercritical water reactor 40 had an internal volume of 0.16 liters and a residence time of the fluids of 1.6 minutes. Supercritical water reactor 40A had an internal volume of 1.0 liter and a residence time of the fluids at 9.9 minutes. Both supercritical water reactor 40 and supercritical water reactor 40A were maintained at a temperature of 420° C. and pressure of 25 MPa. The use of two reactors increased the mixing of mixed stream 140. The length to diameter ratio of supercritical water reactor 40A resulted in a high turbulence to enhance the mixing of the stream flowing through supercritical water reactor 40. Reaction conditions were maintained such that reactor effluent 150 was at a temperature of 420° C. and 25 MPa upon exiting the supercritical water unit. Reactor effluent 150 was fed to cooling device 50, where the temperature was reduced to 50° C. to produce cooled stream 160. Cooled stream 160 was fed to depressurizing device 70 where the pressure was reduced to atmospheric pressure to produce depressurized stream 172. Depressurized stream 172 was fed to gas-liquid separator 80 to separate depressurized stream 172 into gas product 202 and liquid phase stream 192. Gas-liquid separator 80 was a 500 ml vessel. Liquid phase stream 192 was then fed to oil-water separator 90, a batch-type centrifuge unit, where liquid phase stream 192 was separated into liquid-phase petroleum 212 and water product 222. Liquid-phase petroleum 212 included both liquid-phase petroleum and metal impurities. Liquid-phase petroleum 212 was extracted with n-pentane using a n-pentane to petroleum product ratio of 10:1 by volume in extractor 92. After filtering out metal-containing fraction 214, the remaining liquid was subjected to a rotary evaporator where the n-pentane was removed leaving petroleum product 210. Metal-containing fraction 214 was 0.9 wt % of liquid-phase petroleum 212. Petroleum product 210, now free from n-pentane, had a vanadium content of 0.5 wt ppm. The vanadium content in petroleum product 210 indicates that the remaining vanadium was concentrated in metal-containing fraction 214. The liquid yield of petroleum product 210 was 99.5 wt % measured as 100% minus metal-containing fraction 214, with loss of liquid occurring during the oil/water separation step in oil-water separator 90. This example shows that the process of the present invention results in better liquid yields than conventional solvent deasphalting processes which have low liquid yields, around 75 wt %. Properties of petroleum feedstock 105 and liquid-phase petroleum 212 are in Table 1.

TABLE 1

Composition and Properties of Petroleum Streams

| | API Gravity | Heptane Insoluble (Asphaltene) | Vanadium Content (wt ppm) |
|---|---|---|---|
| Petroleum Feedstock 105 | 33.1 | 2.0 wt % | 13.0 |
| Liquid-Phase Petroleum 212 | 35.6 | 0.6 wt % | 2.5 |

The toluene insoluble fraction of liquid-phase petroleum 212 was lower than 0.1 wt % of the product. The "toluene insoluble fraction" is a measure of the amount of coke and a fraction of 0.1 wt % can be considered coke free.

Example 2

Figure 3:
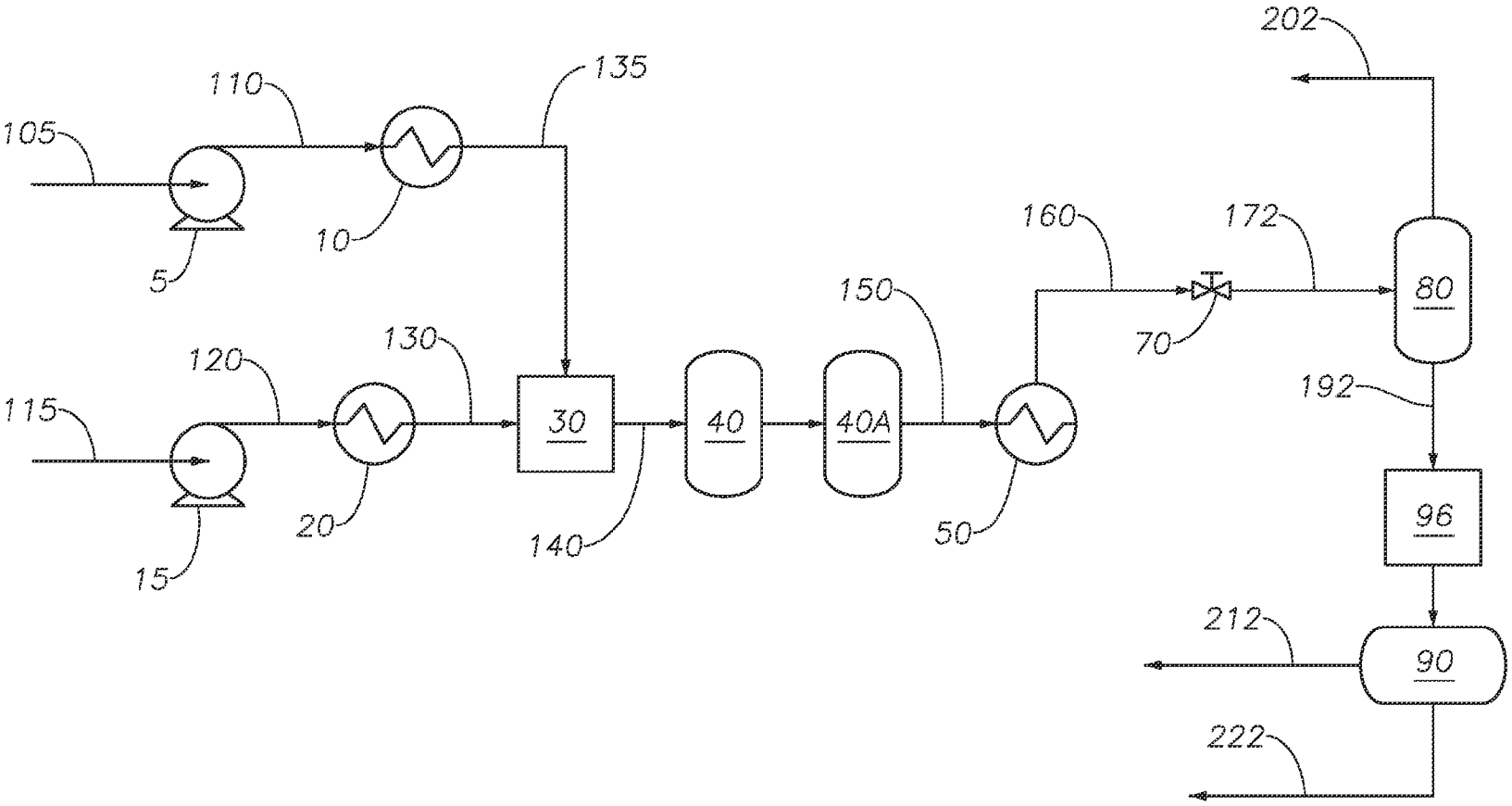
FIG. 3 provides a block diagram of an embodiment of a sequential mixer according to the present invention.

Example 2 was a pilot scale simulation conducted according to the set-up described with reference to FIG. 3 and example 1. In example 2, activated carbon was added to liquid product 192 at a weight ratio of activated carbon to liquid product of 1:200 (0.5 wt % of carbon black was added to liquid product 192). The mixture was subjected to ultrasonic irradiation in ultrasonic generator 96 for 15 minutes. Next, the mixture was stirred at 50° C. After being stirred, the mixture was centrifuged in oil-water separator 90 to produce water product 222 and petroleum 212. Tests showed that the activated carbon was in water product 222. Liquid yield was 99 wt %. Petroleum 212 had a vanadium content of 0.4 wt ppm. The results of example 2 show that the rejecter (in this example, a centrifuge was used to concentrate the sludge in the bottom of a centrifuge tube). and an adsorbent can remove a metals impurity from a petroleum feedstock.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

That which is claimed is:

1. A method to remove a metals impurity from a petroleum feedstock for use in a power generating process, the method comprising the steps of:

mixing a heated feedstock with a heated water stream in a mixing device to produce a mixed stream, the heated feedstock comprising the metals impurity, wherein the heated feedstock is heated to a feedstock temperature of 150° C. and a feedstock pressure greater than the critical pressure of water, wherein the heated water stream is heated to a water temperature above the critical temperature of water and a water pressure above the critical pressure of water, wherein the mixed stream comprises an asphaltene and resin portion, a hydrocarbon portion, and a supercritical water portion;

introducing the mixed stream to a supercritical water reactor in the absence of externally provided hydrogen and externally provided oxidizing agent to produce a reactor effluent, the reactor effluent comprising a refined petroleum portion, converted metals, and an amount of solid coke, wherein demetallization reactions and a set of conversion reactions occur in the supercritical water reactor, wherein the demetallization reactions are operable to convert the metals impurity to converted metals, wherein the set of conversion reactions is operable to refine the hydrocarbon portion in the presence of the supercritical water portion to produce the refined petroleum portion;

cooling the reactor effluent in a cooling device to produce a cooled stream;

feeding the cooled stream to a rejecter separator process vessel, the rejecter separator process vessel configured to separate a sludge fraction from the cooled stream to produce a de-sludged stream, the rejecter separator process vessel having a rejecter temperature, the sludge fraction comprising the asphaltene and resin portion and the converted metals;

reducing the pressure of the de-sludged stream in a depressurizing device to produce a depressurized product;

separating the depressurized product in a gas-liquid separator to produce a gas phase product and a liquid product;

separating the liquid product in an oil-water separator to produce a petroleum product and a water product, the petroleum product having a liquid yield, the petroleum product having a reduced asphaltene content, reduced concentration of metals impurity, and reduced sulfur as compared to the petroleum feedstock.

2. The method of claim 1, wherein the petroleum feedstock is a petroleum-based hydrocarbon selected from the group consisting of whole range crude oil, reduced crude oil, fuel oil, refinery streams, residues from refinery streams, cracked product streams from crude oil refinery, atmospheric residue streams, vacuum residue streams, coal-derived hydrocarbons, liquefied coal, bitumen, biomass-derived hydrocarbons, and hydrocarbon streams from other petrochemical processes.

3. The method of claim 1, wherein the metals impurity is selected from the group consisting of vanadium, nickel, iron and combinations thereof.

4. The method of claim 1, wherein the metals impurity comprises a metal porphyrin.

5. The method of claim 1, wherein the set of conversion reactions is selected from the consisting of upgrading, desulfurization, denitrogenation, deoxygenation, cracking, isomerization, alkylation, condensation, dimerization, hydrolysis, hydration, and combinations thereof.

6. The method of claim 1, wherein the rejecter separator process vessel comprises a rejecter adsorbent.

7. The method of claim 1, wherein the rejecter separator process vessel comprises a rejecter solvent.

8. The method of claim 1, wherein the rejecter separator process vessel is selected from the group consisting of a cyclone-type vessel, a tubular-type vessel, a CSTR, and a centrifuge.

9. The method of claim 1, wherein the amount of solid coke in the reactor effluent is less than 1.5 wt % by petroleum feedstock.

10. The method of claim 1, wherein the concentration of metals impurity in the petroleum product is less than 2 ppm by wt.

11. The method of claim 1, wherein the liquid yield of the petroleum product is greater than 96%.

12. A method to remove a metals impurity from a petroleum feedstock for use in a power generating process, the method comprising the steps of:

mixing a heated feedstock with a heated water stream in a mixing device to produce a mixed stream, the heated feedstock comprising the metals impurity, wherein the heated feedstock is heated to a feedstock temperature of 150° C. and a feedstock pressure greater than the critical pressure of water, wherein the heated water stream is heated to a water temperature above the critical temperature of water and a water pressure above the critical pressure of water, wherein the mixed stream comprises an asphaltene and resin portion, a hydrocarbon portion, and a supercritical water portion;

introducing the mixed stream to a supercritical water reactor in the absence of externally provided hydrogen and externally provided oxidizing agent to produce a reactor effluent, the reactor effluent comprising a refined petroleum portion and converted metals, wherein a demetallization reaction and a set of conversion reactions occur in the supercritical water reactor, wherein the demetallization reactions are operable to convert the metals impurity to converted metals, wherein the set of conversion reactions is operable to refine the hydrocarbon portion in the presence of the supercritical water portion to produce the refined petroleum portion;

cooling the reactor effluent in a cooling device to produce a cooled stream;

reducing the pressure of the cooled stream in a depressurizing device to produce a depressurized stream, wherein the depressurized stream comprises the refined petroleum portion, an asphaltene fraction, a water fraction, and a gas phase product fraction;

separating the depressurized stream in a gas-liquid separator to produce a gas product and a liquid phase stream;

separating the liquid phase stream in an oil-water separator to produce a liquid-phase petroleum stream and a water phase stream;

feeding the liquid-phase petroleum stream to a solvent extractor;

extracting a petroleum product from the liquid-phase petroleum stream in the solvent extractor to leave a metal-containing fraction, the petroleum product having reduced asphaltene content, reduced concentration of metals impurity, and reduced sulfur as compared to the petroleum feedstock.

13. The method of claim 11, wherein the petroleum feedstock is a petroleum-based hydrocarbon selected from the group consisting of whole range crude oil, reduced crude oil, fuel oil, refinery streams, residues from refinery streams, cracked product streams from crude oil refinery, atmospheric residue streams, vacuum residue streams, coal-derived hydrocarbons, liquefied coal, bitumen, biomass-derived hydrocarbons, and hydrocarbon streams from other petrochemical processes.

14. The method of claim 11, wherein the metals impurity is selected from the group consisting of vanadium, nickel, iron and combinations thereof.

15. The method of claim 11, wherein the metals impurity comprises a metal porphyrin.

16. The method of claim 11, wherein the set of conversion reactions is selected from the consisting of upgrading, desulfurization, denitrogenation, deoxygenation, cracking, isomerization, alkylation, condensation, dimerization, hydrolysis, hydration, and combinations thereof.

17. The method of claim 11, wherein the solvent extractor comprises a solvent deasphalting process.

18. The method of claim 11, wherein the amount of solid coke in the reactor effluent is less than 1.5 wt % by petroleum feedstock.

19. The method of claim 11, wherein the concentration of metals impurity in the petroleum product is less than 2 ppm by wt.

* * * * *